US007140442B2

(12) United States Patent
Mackay et al.

(10) Patent No.: US 7,140,442 B2
(45) Date of Patent: Nov. 28, 2006

(54) TUBING INJECTOR

(75) Inventors: Alexander Craig Mackay, Banchory (GB); Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 292 days.

(21) Appl. No.: 10/490,242

(22) PCT Filed: Mar. 19, 2003

(86) PCT No.: PCT/GB03/01195

§ 371 (c)(1),
(2), (4) Date: Mar. 19, 2004

(87) PCT Pub. No.: WO03/080990

PCT Pub. Date: Oct. 2, 2003

(65) Prior Publication Data

US 2005/0039926 A1 Feb. 24, 2005

(30) Foreign Application Priority Data

Mar. 19, 2002 (GB) ..... 0206414.5

(51) Int. Cl.
*E21B 19/08* (2006.01)

(52) U.S. Cl. ..... 166/380; 166/77.2; 166/77.4

(58) Field of Classification Search ..... 166/380, 166/77.2, 77.4
See application file for complete search history.

(56) References Cited

U.S. PATENT DOCUMENTS 5,553,668 A 9/1996 Council et al.
5,975,203 A 11/1999 Payne et al.
5,992,516 A * 11/1999 Palynchuk et al. ..... 166/77.2
6,173,769 B1 1/2001 Goode
6,209,634 B1 4/2001 Avakov et al.
6,349,767 B1 * 2/2002 Gissler ..... 166/242.6

FOREIGN PATENT DOCUMENTS

| | | |
|---|---|---|
| EP | 0 507 280 | 10/1992 |
| GB | 2 099 486 | 12/1982 |
| GB | 2 112 047 | 7/1983 |
| GB | 2 180 869 | 4/1987 |
| GB | 2 302 076 | 1/1997 |
| GB | 2 357 530 | 6/2001 |
| WO | WO 02/06626 | 1/2002 |

OTHER PUBLICATIONS

GB Search Report dated Jun. 25, 2002 form GB Application No. 0206414.5.

International Search Report from International Application No. PCT/GB03/01195, dated Jun. 25, 2003.

* cited by examiner

*Primary Examiner*—William Neuder
(74) *Attorney, Agent, or Firm*—Patterson & Sheridan, LLP

(57) ABSTRACT

A tubing injector for injecting tubing (4) into a pipeline or bore or the like comprises: an annular piston for moving the tubing (4); a collet for gripping the tubing on movement of the piston in an injecting direction, the collet (14) and the tubing being movable with the piston, and the collet being releasable from the tubing (4) on movement of the piston in another direction, and a ratchet collet for preventing the tubing from being ejected.

35 Claims, 2 Drawing Sheets

TUBING INJECTOR

FIELD OF THE INVENTION

The present invention relates to a tubing injector, in particular an injector for conveying coiled tubing or the like through a bore or other such opening.

BACKGROUND OF THE INVENTION

The oil and gas industry makes wide use of coiled tubing, in for example well intervention, coiled tubing drilling and pipeline maintenance. In order to inject tubing into a well, and also pull it therefrom, a tubing injector must be provided on the surface. Conventional tubing injectors are large and heavy, and also relatively complex. The main reason for this is the very large pulling and injection forces required for the successful deployment of the tubing.

In order to repair sub-sea pipelines, coiled tubing can be injected through a hot tap while the pipeline is under a pressure of typically 100–200 bar. This tubing is used to deploy inflatable stoppers or plugs to isolate particular pipeline sections. By doing this, repairs can be made to the isolated sections without having to close down the entire pipeline, which as will be appreciated would incur considerable costs and cause considerable inconvenience.

A problem with existing injectors is that injection and indeed ejection of coiled tubing can be difficult to control when there is a pressure differential between the pipeline and the exterior of the tool. Typically, large injection and pulling forces are needed, which as noted above, means that equipment tends to be large and heavy. This can cause problems, because pipeline repairs often need to be done at short notice, anywhere in the world and deployed from a variety of support vessels. The need for rapid deployment means that it is important that tubing injectors are compact and can be easily broken down into small parts for transportation by conventional aircraft and/or helicopter. In addition, the injectors have to be simple enough to be reliable and easily stripped down and serviced in the field.

An object of at least one embodiment of the invention is to provide a simple and compact coiled tubing injector.

SUMMARY OF THE INVENTION

According to the present invention, there is provided a tubing injector for injecting tubing into a pipeline or bore or the like, the injector comprising:

translation means for moving the tubing;

gripping means for gripping the tubing on movement of the translation means in an injecting direction, the gripping means and the tubing being movable with the translation means, and the gripping means being releasable from the tubing on movement of the translation means in another direction, and retaining means for preventing the tubing from being ejected.

Having the gripping means in engagement with the tubing and movable with the translation means causes the tubing to be fed or injected into the pipeline. Return movement of the tubing in an ejection direction is avoided when the gripping means is released by the action of the retaining means.

The gripping means may be annular, for example a collar, preferably a collet. The collet may be spring energised and/or dual action. Means may be provided for releasing the gripping means, for example a piston, in particular a hydraulically actuated piston.

The retaining means may be operable to retain the tubing when the retaining means are in their steady state or normal condition. Movement of the tubing in an injection direction may release the retaining means. The retaining means may be mechanically actuatable, preferably automatically by reverse movement of the tubing. The retaining means may be spring actuated. The retaining means are preferably provided internally of the tool. The retaining means may comprise a ratchet. The retaining means may comprise a collet, for example a ratchet collet. The retaining means may be releasable. The retaining means may be releasable by the action of a piston, for example a hydraulically actuated piston.

The translation means may be annular and extend around the tubing in use. The translation means may be a piston, preferably an annular piston. Use of an annular piston and an annular gripping means, allows the injector to be generally elongate, extending along an axis of the tubing. This helps reduce the overall bulk and size of the injector.

According to another aspect of the invention, there is provided a method of injecting tubing into a pipeline or bore or the like, the method comprising:

gripping the tubing using gripping means;

moving the gripping means and the tubing in an injection direction;

retaining the tubing in a relatively fixed position using retaining means disposed internally of the tool; and releasing the gripping means.

By retaining the tubing using the retaining means the gripping means can be released and moved, without any danger of the tubing being ejected due to internal pressure in the pipeline.

The steps of retaining and releasing may be effected automatically on movement of the gripping means.

According to still another aspect of the invention, there is provided a method of ejecting tubing from a pipeline or the like, the method comprising:

retaining the tubing in a relatively fixed position using retaining means disposed internally of the tool;

gripping the tubing using gripping means;

releasing the retaining means;

moving the gripping means towards an upper end of the injector to eject the tubing;

re-applying the retaining means to prevent further ejection;

releasing the gripping means;

moving the gripping means to an ejection position towards a lower end of the injector;

gripping the tubing using the gripping means;

releasing the retaining means, and moving the gripping means towards the upper end of the injector.

By carefully controlling the action of the gripping and the retaining means, it can be ensured that the tubing is at all times held securely within the tool and can be ejected in a controlled manner. This can be done even when there is a significant pressure differential, which would otherwise tend to eject the tubing in an uncontrolled and potentially dangerous manner.

According to yet another aspect of the invention, there is provided a tubing injector for injecting tubing into a pipeline or bore or the like, the injector comprising a plurality of detachable units, which units are co-axially connectable to define an elongate housing, through which tubing can pass. The units may be adapted to be screw fitted together.

By providing co-axially detachable/connectable units, the injector can be disassembled and transported easily.

One of the units may include a translation means for moving the tubing. Another of the units may include gripping means for gripping the tubing on movement of the translation means in an injecting direction, the gripping means and the tubing being movable with the translation means, and the gripping means being releasable from the tubing on movement of the translation means in another direction. The gripping means may be a collet. Yet another of the units may include retaining means for preventing the tubing from moving in an ejection direction. The retaining means may be a collet, preferably a ratchet collet.

BRIEF DESCRIPTION OF THE DRAWINGS

Various aspects of the invention will now be described, by way of example only, with reference to the accompanying drawings, in which.

DETAILED DESCRIPTION OF THE DRAWINGS

Figure 1:
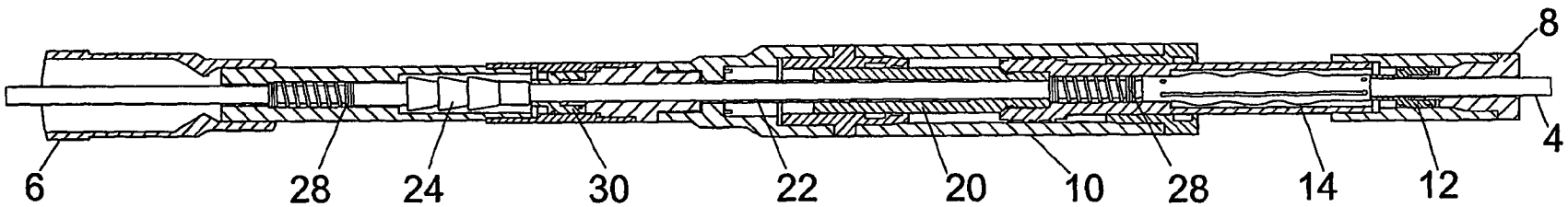
FIG. 1 is partially sectioned view of a tubing injector, with a tube shown in situ.
Figure 2:
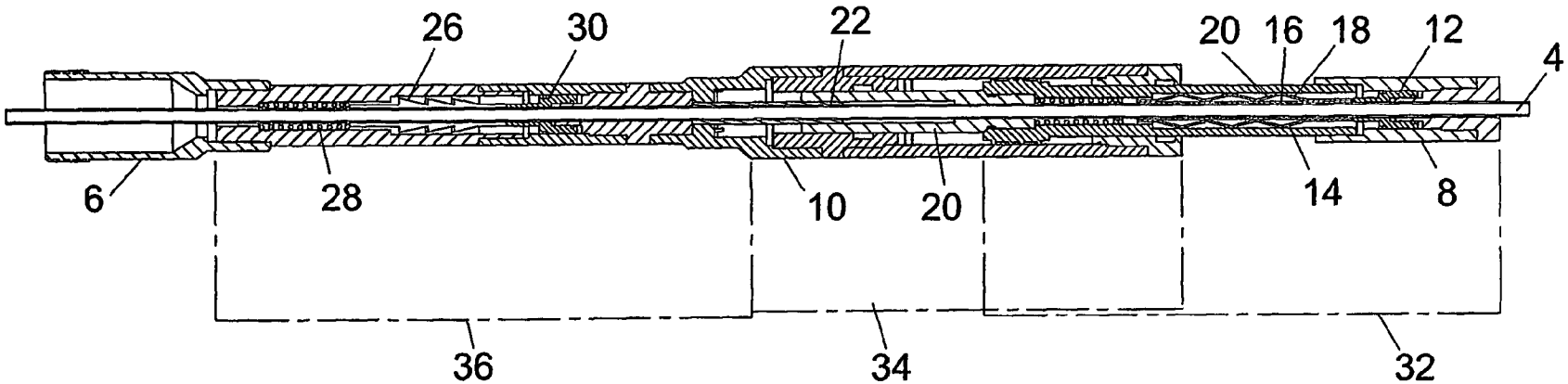
FIG. 2 is a section on the line A—A of the injector of FIG. 1.

The injector of FIGS. 1 and 2 has an elongate tool housing 10 along a longitudinal axis of which lie the parts of the injector, these parts being coaxial and arranged to define a central through passage for coiled tubing 4. For the purposes of this description, the lower end 6 of the injector is defined as the end that is closest to the pipeline or bore into which the tubing 4 is to be injected, the upper end 8 being the other end.

At the upper end 8 of the tool housing 10 is a hydraulically actuatable annular release piston 12 that is operable to release a double acting shuttle collet 14 that is energisable by a spring 15. Included in the shuttle collet 14 are collet members 16 that have two annular surfaces, one of which 18 is tapered towards the upper end 8 of the tool, the other 20 being tapered towards the lower end 6 of the tool, as shown in FIG. 2. These collet members 16 are movable towards the upper end of the tool within similarly shaped cavities defined in the tool housing 10. In a normal condition, the shuttle collet members 16 are biased by the energising spring 15 against the cavity walls and inwardly towards the central axis of the tool, thereby to grip any tubing 4 that is in situ. However, movement of the shuttle collet towards the upper end 8 of the injector releases the collet members 16 from their gripping engagement.

Shuttle collet 14 is a double acting collet and can be released by the application of hydraulic pressure to the shuttle collet release piston 12. The release piston 12 can also be used to cause the shuttle collet 14 to act in the opposite direction, i.e. pull rather than push. This is done by over-riding the energising spring.

Connected to shuttle collet 14 is an annular push-pull (double-acting) or stroke piston 20. At a lower end of the piston is a coiled tubing guide 22 for guiding tubing towards a lower part of the tool and to prevent tubing buckling. The piston 20 is adapted to slide over this guide 22. In use, downwards movement of the piston 20, towards the lower end 6 of the tool, causes the shuttle collet 14 to move. Because the shuttle collet members 16 grip the tubing 4 that is within the injector, this movement of the piston 20 causes both the shuttle collet 14 and the tubing 4 to move in a downwards direction, so that the tubing 4 is injected.

At the lower end 6 of the tool is a single acting collet 24, sometimes referred to as a ratchet collet, for gripping the tubing. This is energised by a spring 28. Included in the ratchet collet 24 are annular ratchet collet members 26 that are tapered towards the upper end 8 of the tool, as shown in FIG. 2. The ratchet members 26 are movable within similarly shaped cavities in the tool housing. The ratchet collet members 26 and housing are shaped so that in normal condition they are forced by the action of the spring 28 against the cavity walls and inwardly towards the axis of the tool, thereby to grip the tubing 4. However, movement of the tubing 4 towards the lower end 6 of the injector releases the collet members 26 from their gripping engagement to allow the tubing 4 to be injected. In the event that the tubing is stationary or indeed moves towards the upper end of the injector, the spring 28 biases the collet members 26 against the tubing 4, thereby preventing the tubing from moving out of the injector.

As will be appreciated, the ratchet collet 24 is unidirectional in the sense that it does not affect movement of tubing towards the lower end 6 of the tool, but acts to prevent the tubing 4 moving towards the upper end 8. The ratchet collet 24 is spring 28 energised and can be released by the action of an annular hydraulic release piston 30, which piston 30 is provided between the tubing guide 22 and the ratchet collet 24. However, in the event that the unit is being used in a reverse pressure application, such as in very deep water where the ambient pressure outside the pipeline exceeds the internal pipeline pressure, the orientations of the ratchet collet 24 and the shuttle collet 14 may be reversed.

In order to simplify assembly of the tool of FIGS. 1 and 2, the housing 10 is preferably divided into several detachable units. For example, the shuttle collet 14 and the shuttle collet release piston 12 could be provided in an elongate unit 32 that is releasably attachable to the piston 20. Likewise, the piston 20 may be housed in a unit 34 that is releasably attachable to another unit 36 that includes the ratchet collet 24 and the ratchet collet release piston 30. The units 32,34 and 36 may be attachable in any suitable way, for example using a simple screw fitting arrangement. By providing detachable units, the injector can be readily disassembled for transportation, for example by air, and equally easily assembled as and when desired.

In normal operation of the injector of FIGS. 1 and 2, tubing 4, for example composite coil tubing, is inserted through the tool and injection is caused by the dual action of the shuttle collet 14 and the stroke piston 20. While injecting, no hydraulic pressure is provided to either the shuttle collet release piston 12 or the rachet collet release piston 30. Movement of the piston 20 downwards towards the lower end 6 of the tool causes the shuttle collet 14, which is in gripping engagement with the tubing 4, to move. Continued movement downwards causes both the shuttle collet 14 and the tubing 4 to move through the tool, thereby injecting the tubing into the pipe.

Once the piston 20 is fully extended, it begins its return stroke. At this stage the tubing 4 is still gripped by the shuttle collet 14. However, movement of the tubing 4 in the reverse direction towards the upper end 8 of the tool causes the ratchet collet 24 to move into its steady state gripping position. Subsequent movement of the piston 20, and so the tubing 4, in the reverse direction causes the ratchet collet 24 to increase its grip on the tubing 4 at the same time as releasing the shuttle collet 14. In this way, the piston 20 and shuttle collet 14 can be returned to the starting position, whilst rearwards movement of the tubing 4 is prevented by the ratchet collet 24.

When removing the coiled tubing 4 from the pipeline, it is necessary to control the rate at which the tubing 4 may be ejected by the pressure differential within the pipeline and the ambient pressure outside the line. This pressure is contained by a conventional stuffing box (not shown).

In this mode, during ejection, the ratchet collet 24 is released, using release piston 30, when the piston 20 is in the downwards position with the shuttle collet 14 gripping the coiled tubing 4. The tubing 4 can then be allowed to eject itself by controlling the fluid release from the pressure side of the stroke piston 20 until it has returned to its upwards position. At this stage, or just before it, the hydraulic pressure is released from the ratchet collet release piston 30 causing the ratchet collet 24 to grip the coiled tubing 4, preventing further ejection.

To return the stroke piston 20 to the downward position, hydraulic pressure is applied to the shuttle collet release piston 12. This releases the grip of the shuttle collet 14 and allows the stroke piston 20 to move down the now stationary coiled tubing 4. Hydraulic pressure to the shuttle collet release piston 12 is removed before the stroke piston 20 reaches its full downward position, allowing the shuttle collet 14 to grip the tubing 4 and take the load off the ratchet collet 24 ready for the next return stroke of the system. By repeating this sequence, the tubing can be removed from the pipeline in a controlled manner.

Control of the tubing injection operation is achieved using a hydraulic control system (not shown). This system is configured to prevent the possibility of hydraulic release pressure being applied to both of the ratchet collet 24 and the shuttle collet 14 at the same time, and thus provides for failsafe operation. The control system also ensures that the ratchet collet 24 can only be hydraulically released when the piston 20 is in the downwards position with sufficient hydraulic activation pressure behind it to control the ejection force of the coiled tubing 4 being removed from the pipeline.

In the event that no pressure differential exists between the pipeline bore and ambient outside pressure then the double acting feature of the shuttle collet can be used to pull the tubing from the pipeline simply by changing the hydraulic sequence of operations.

The injector in which the invention is embodied is simple and compact. By using annular collets, gripping can be maximised and damage to the tubing minimised. The injector can also be manufactured at relatively low cost and requires low maintenance. Hence, it can be serviced and operated at remote locations around the world. Furthermore, it can be made of a low weight and size for deployment subsea.

It will be clear to those skilled in the art that the above-described embodiment is merely exemplary of the present invention, and that various modifications and improvements may be made thereto without departing from the scope of the invention. For example, as noted above, a modified unit in accordance with a further embodiment of the invention may be used in a reverse pressure application, such as in very deep water (1,000 to 2,000 metres) where the ambient pressure outside the pipeline exceeds the internal pipeline pressure. For such an application the orientations of the ratchet collet 24 and the shuttle collet 14 are reversed, to allow the unit to control the injection of the coiled tubing 4 in the presence of a pressure differential tending to push the tubing 4 into the pipeline. Conversely, the unit will be operated to draw the tubing 4 from the pipeline during ejection, against the pressure force tending to draw the tubing 4 into the pipeline.

The invention claimed is:

1. A tubing injector for injecting tubing into a pipeline or bore or the like, the injector comprising:

a translation device for translating the tubing;

a gripping device movable by the translation device, the gripping device being operable to grip the tubing during movement of the translation device in an injecting direction, thereby to inject the tubing, and to be released from the tubing on movement of the translation device in another direction, wherein the gripping device is located at least partially within the translation device; and a retaining device for preventing the tubing from being ejected.

2. An injector as claimed in claim 1, wherein the gripping device is operable to grip the tubing when in a normal or steady state condition.

3. An injector as claimed in claim 1, wherein the gripping device is adapted so that movement of the translation device in the said other direction moves the gripping device to a configuration in which the tubing is released therefrom.

4. An injector as claimed in claim 1, wherein the gripping device is a collet.

5. An injector as claimed in claim 1, wherein the collet is spring-energized.

6. An injector as claimed in claim 4, wherein the collet is dual action.

7. An injector as claimed in claim 1, wherein a member is provided for releasing the gripping device.

8. An injector as claimed in claim 7, wherein the member for releasing comprises a release piston.

9. An injector as claimed in claim 8, wherein the release piston is a hydraulically actuated piston.

10. An injector as claimed in claim 1, wherein the retaining device is operable to retain the tubing when the tubing is not moving in the iniecting direction.

11. An injector as claimed in claim 10, wherein the retaining device is operable to be released on movement of the tubing in the injection direction.

12. An injector as claimed in claim 11, wherein the retaining device is automatically released on movement of the tubing in the injection direction.

13. An injector as claimed in claim 1, wherein the retaining device is mechanically actuatable.

14. An injector as claimed in claim 1, wherein the retaining device is spring actuated.

15. An injector as claimed in claim 1, wherein the retaining device is provided internally of the injector.

16. An injector as claimed in claim 1, wherein the retaining device comprises a ratchet.

17. An injector as claimed in claim 1, wherein the retaining device comprises a collet.

18. An injector as claimed in claim 17, wherein the retaining device comprises a ratchet collet.

19. An injector as claimed in claim 1, wherein a device for releasing the retaining device is provided.

20. An injector as claimed in claim 19, wherein the device for releasing the retaining device comprises a piston.

21. An injector as claimed in claim 20, wherein the device for releasing the retaining device comprises a hydraulically actuated piston.

22. An injector as claimed in claim 1, wherein the translation device is annular and adapted to extend around the tubing.

23. The injector of claim 1, wherein the translation device is a piston and cylinder assembly.

24. The injector of claim 23, wherein the gripping device is a collet.

25. The injector of claim 24, wherein the collet is spring energized.

26. A method of injecting tubing into a pipeline or bore or the like, the method comprising:

gripping the tubing using a gripping device;

moving the gripping device and the tubing in an injection direction with a translation device, wherein the gripping device is located at least partially within the translation device;

retaining the tubing in a relatively fixed position using a retaining device; and releasing the gripping device.

27. The method of claim 26, wherein the translation device is a piston and cylinder assembly.

28. The injector of claim 27, wherein the gripping device is a collet.

29. A method of ejecting tubing from a pipeline or the like, the method comprising:

retaining the tubing in a relatively fixed position using a retaining device;

gripping the tubing using a gripping device;

releasing the retaining device;

moving the gripping device towards an upper end of the injector to eject the tubing with a piston and cylinder assembly, wherein the gripping device is located at least partially within the piston and cylinder assembly;

re-applying the retaining device to prevent further ejection;

releasing the gripping device;

moving the gripping device to a position towards a lower end of the injector;

gripping the tubing using the gripping device;

releasing the retaining device; and moving the gripping device towards the upper end of the injector.

30. A tubing injector for injecting tubing into a pipeline or bore or the like, the injector comprising a plurality of detachable units, the units being co-axially connectable to define an elongate housing; through which tubing can pass, wherein at least one of the units includes:

a collet movable by a translation device; and a gripping device being operable to grip the tubing during movement of the translation device in an injecting direction, thereby to inject the tubing, and to be released from the tubing on movement of the translation device in another direction.

31. An injector as claimed in claim 30, wherein the units are adapted to be screw fitted together.

32. An injector as claimed in claim 30, wherein yet another of the units includes a retaining device for preventing the tubing from moving in a reverse or ejection direction.

33. An injector as claimed in claim 32, wherein the retaining device comprises a collet.

34. An injector as claimed in claim 33, wherein the retaining device comprises a ratchet collet.

35. A tubing injector for injecting tubing into a pipeline or bore or the like, the injector comprising:

a translation device for the tubing;

a gripping device movable by the translation device, the gripping device being operable to grip the tubing during movement of the translation device in an injecting direction, and to be released from the tubing on movement of the translation device in another direction; and a retaining device for preventing the tubing from being ejected, wherein the retaining device is provided internally of the injector.

* * * * *

UNITED STATES PATENT AND TRADEMARK OFFICE

CERTIFICATE OF CORRECTION

PATENT NO. : 7,140,442 B2
APPLICATION NO. : 10/490242
DATED : November 28, 2006
INVENTOR(S) : Mackay et al.

It is certified that error appears in the above-identified patent and that said Letters Patent is hereby corrected as shown below:

In the Claims:

In Column 6, Claim 5, Line 21, please delete "1" and insert --4--;

In Column 6, Claim 10, Line 33, please delete "iniecting" and insert --injecting--.

Signed and Sealed this

Twenty-sixth Day of June, 2007

JON W. DUDAS
*Director of the United States Patent and Trademark Office*